US010400638B2

(12) United States Patent
Poole et al.

(10) Patent No.: US 10,400,638 B2
(45) Date of Patent: Sep. 3, 2019

(54) CAMSHAFT PHASER ARRANGEMENT FOR A CONCENTRICALLY ARRANGED CAMSHAFT ASSEMBLY

(71) Applicant: Schaeffler Technologies AG & Co. KG, Herzogenaurach (DE)

(72) Inventors: Kevin Poole, Northville, MI (US); Jeffrey Mossberg, Troy, MI (US); Andrew Mlinaric, Tecumseh (CA); Steven Burke, Fort Gratiot, MI (US); Donald Haefner, Troy, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/927,174

(22) Filed: Mar. 21, 2018

(65) Prior Publication Data

US 2019/0170027 A1 Jun. 6, 2019

Related U.S. Application Data

(60) Provisional application No. 62/593,619, filed on Dec. 1, 2017.

(51) Int. Cl.

| | |
|---|---|
| ***F01L 1/344*** | (2006.01) |
| ***F01L 1/047*** | (2006.01) |
| *F01L 1/02* | (2006.01) |

(52) U.S. Cl.

CPC ..... *F01L 1/3442* (2013.01); *F01L 1/047* (2013.01); *F01L 1/022* (2013.01); *F01L 1/024* (2013.01);

(Continued)

(58) Field of Classification Search

CPC ..... F01L 2001/0473; F01L 2001/0535; F01L 1/344; F01L 1/34413; F01L 1/3442;

(Continued)

(56) References Cited

U.S. PATENT DOCUMENTS

| | | | | |
|---|---|---|---|---|
| 7,305,948 | B2 | 12/2007 | Heintzen et al. | |
| 2005/0279302 | A1* | 12/2005 | Lancefield | F01L 1/024 123/90.15 |

(Continued)

OTHER PUBLICATIONS

U.S. Appl. No. 15/815,762, Schaeffler Technologies AG & Co. KG.
U.S. Appl. No. 15/269,517, Schaeffler Technologies AG & Co. KG.

*Primary Examiner* — Jorge L Leon, Jr.
(74) *Attorney, Agent, or Firm* — Matthew V. Evans

(57) ABSTRACT

A camshaft phaser arrangement configured for a concentric camshaft assembly having an inner camshaft and an outer camshaft is provided. The camshaft phaser arrangement can facilitate independent phasing of intake and exhaust valves. The camshaft phaser arrangement includes a first driven wheel and a second driven wheel, both configured to be driven by a driving wheel. A first camshaft phaser is connected to the first driven wheel and configured to be connected to either the inner or outer camshaft. A second camshaft phaser is connected to the second driven wheel and configured to be connected to either the inner or outer camshaft which is not connected to the first driven wheel. A motion transfer assembly can connect the second camshaft phaser to the concentric camshaft assembly. One or both of the camshaft phasers can be an electric camshaft phaser or a hydraulic camshaft phaser.

20 Claims, 7 Drawing Sheets

(52) U.S. Cl.
CPC ..... *F01L 1/026* (2013.01); *F01L 2001/34493* (2013.01)

(58) Field of Classification Search
CPC ... F01L 2001/34486; F01L 2001/34489; F01L 2001/34493; F01L 2013/103; F01L 2250/02; F01L 2250/04; F01L 2250/06; F01L 2820/032
USPC ..... 123/90.17, 90.27, 90.31
See application file for complete search history.

(56) References Cited

U.S. PATENT DOCUMENTS

2007/0272183 A1* 11/2007 Schneider ..... F01L 1/047 123/90.17
2009/0084333 A1* 4/2009 Cleary ..... F02D 13/0207 123/90.17
2009/0308338 A1* 12/2009 Tashiro ..... F01L 1/047 123/90.6
2010/0093453 A1* 4/2010 Myers ..... F01L 1/3442 464/160
2010/0186698 A1* 7/2010 Pluta ..... F01L 1/3442 123/90.17
2011/0197839 A1* 8/2011 Yoshika ..... F01L 1/047 123/90.17
2012/0318224 A1* 12/2012 Flender ..... F01M 9/102 123/90.17
2013/0276734 A1* 10/2013 Brodbeck ..... F01L 1/34 123/90.15
2014/0261265 A1* 9/2014 Lonowski ..... F01L 1/34413 123/90.17
2017/0314428 A1* 11/2017 Meusel ..... F01L 1/047

* cited by examiner

CAMSHAFT PHASER ARRANGEMENT FOR A CONCENTRICALLY ARRANGED CAMSHAFT ASSEMBLY

CROSS-REFERENCE TO RELATED APPLICATIONS

This application claims the benefit under 35 U.S.C. § 119(e) of U.S. Provisional Application No. 62/593,619 filed on Dec. 1, 2017 which application is incorporated herein by reference.

TECHNICAL FIELD

This invention is generally related to camshaft phasers, and, more particularly, to camshaft phasers utilized within an internal combustion (IC) engine having a concentrically arranged camshaft assembly.

BACKGROUND

Camshaft phasers are utilized within IC engines to adjust timing of engine valve events to optimize performance, efficiency and emissions. Many different camshaft configurations are possible within an IC engine. Some configurations include an intake camshaft that actuates intake valves, and an exhaust camshaft that actuates exhaust valves; such camshaft configurations can often simplify efforts to independently phase the intake valve events separately from the exhaust valve events. Other camshaft configurations can utilize a single camshaft to actuate both intake and exhaust valves; however, a single camshaft configured with both intake and exhaust lobes makes it difficult to provide independent phasing of the intake and exhaust valves. For this reason, a concentric camshaft arrangement can be implemented that utilizes two camshafts, an inner camshaft and an outer camshaft, each arranged with one of either exhaust lobes or intake lobes. A solution is required for a camshaft phaser arrangement that provides independent phasing of the intake and exhaust valves for an IC engine configured with a concentric camshaft assembly.

SUMMARY

A camshaft phaser arrangement configured for a concentric camshaft assembly having an inner camshaft and an outer camshaft is provided. The camshaft phaser arrangement can facilitate dual independent phasing, or stated otherwise, independent phasing of intake and exhaust valves. The camshaft phaser arrangement includes a first driven wheel and a second driven wheel, both configured to be driven by a driving wheel; the driving wheel can be connected to a crankshaft or any power source capable of driving the first and second driven wheels. A first camshaft phaser is connected to the first driven wheel and configured to be connected to either the inner or outer camshaft. A second camshaft phaser is connected to the second driven wheel and configured to be connected to either the inner or outer camshaft which is not connected to the first driven wheel. In an example embodiment, the first camshaft phaser is configured to be connected to the inner camshaft, and the second camshaft phaser is configured to be connected to the outer camshaft. One or both of the camshaft phasers can be an electric camshaft phaser or one or both of the camshaft phasers can be a hydraulic camshaft phaser. In an example embodiment, at least one of the first or second camshaft phasers is an electric camshaft phaser, configured to receive an electronic signal to actuate the inner or outer camshaft to a desired angular position. The at least one electric camshaft phaser can be configured to actuate either the inner or outer camshaft to a desired angular position during an engine-off or engine startup condition. In an example embodiment, the at least one electric camshaft phaser further comprises an electric motor and a gearbox connected to the electric motor. The electric motor and gearbox are configured to provide phasing or angular control to either the inner or outer camshaft.

The first driven wheel can include a first endless drive band interface, and the second driven wheel can include a second endless drive band interface. Both endless drive band interfaces can be configured to engage an endless drive band that connects the first and second driven wheels to the driving wheel. A first center plane of the first endless drive band interface and a second center plane of the second endless drive band interface can be coplanar, such that the first and second driven wheels can be connected to the driving wheel by a single endless drive band.

The camshaft phaser arrangement can include a motion transfer assembly that is connected to the second camshaft phaser and configured to be connected to either the inner or outer camshaft which is not connected to the first camshaft phaser. The motion transfer assembly can include a first phase control drive wheel, a second phase control driven wheel, and a third intermediate phase control wheel between the first phase control drive wheel and the second phase control driven wheel. The first phase control drive wheel can be actuated by the second camshaft phaser, and the second phase control driven wheel can be configured to be connected to either the inner or outer camshaft. In an example embodiment, the second camshaft phaser is configured to be connected to the outer camshaft by the motion transfer assembly; thus, the second phase control driven wheel is configured to be connected to the outer camshaft.

A camshaft phaser arrangement configured for a concentric camshaft assembly having inner and outer camshafts is provided. The camshaft phaser arrangement includes a first camshaft phaser and a second camshaft phaser. The first camshaft phaser is configured to be coaxially connected with one of the inner or outer camshafts and the second camshaft camshaft phaser is configured to be non-coaxially connected to either the inner or outer camshaft which is not connected to the first camshaft phaser. In an example embodiment, the first camshaft phaser is configured to be connected to the inner camshaft and the second camshaft phaser is configured to be connected to the outer camshaft. A first endless drive band interface can be connected to the first camshaft phaser, and a second endless drive band interface can be connected to the second camshaft phaser. A first center plane of the first endless drive band interface and a second center plane of the second endless drive band interface can be coplanar. One or both of the camshaft phasers can be an electric camshaft phaser or one or both of the camshaft phasers can be a hydraulic camshaft phaser.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
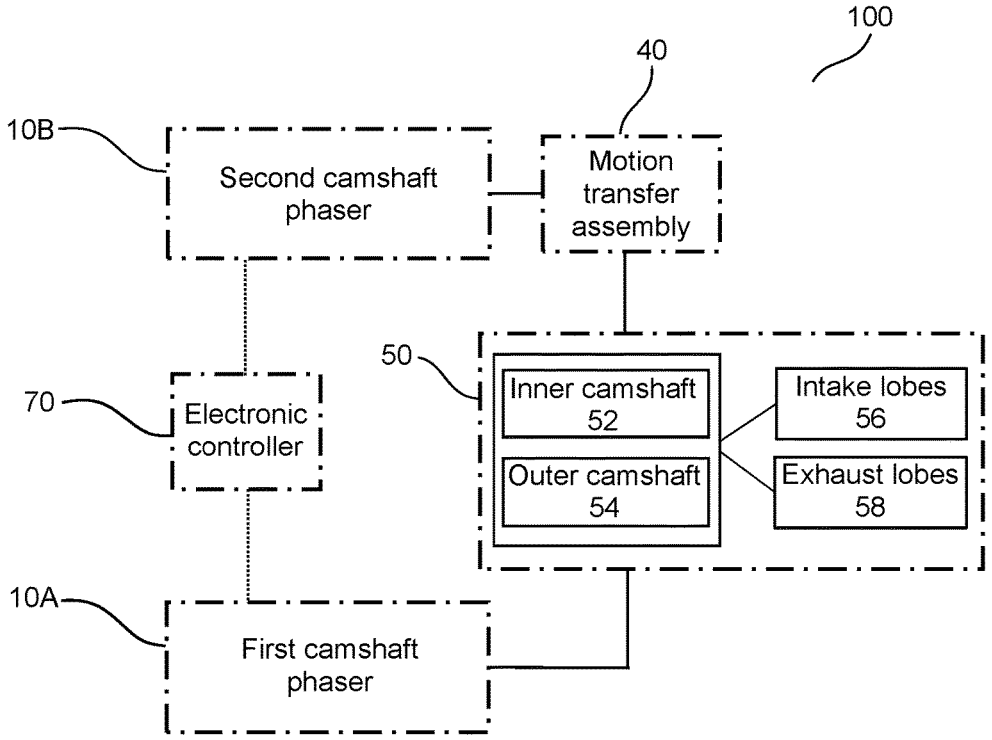
FIG. 1 is a schematic diagram of an example embodiment of a camshaft phaser arrangement that is configured for a concentric camshaft assembly.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

The term "connect" and its derivatives ("connects", "connected", etc.) are used throughout the specification and claims and are intended to define a relationship between components to mean that they are connected in a way to perform a designated function. Therefore, "connect" could mean direct contact between two components, or an operative relationship between two components, such that they may not have direct physical contact.

Referring to FIG. 1, a schematic diagram is shown of an example embodiment of a camshaft phaser arrangement 100 configured for a concentric camshaft assembly 50. The camshaft phaser arrangement 100 includes a first camshaft phaser 10A and a second camshaft phaser 10B, each configured to be connected to the concentric camshaft assembly 50. The first and second camshaft phasers 10A, 10B can be controlled by an electronic controller 70 that determines a desired angular position for each of the camshaft phasers 10A, 10B, with respect to a crankshaft of an IC engine (not shown). The desired angular position can depend on feedback from various sensors arranged in an IC engine and algorithms contained within software utilized by the electronic controller 70. The concentric camshaft assembly 50 can include an inner camshaft 52 and an outer camshaft 54. Intake lobes 56 that actuate intake valves (not shown) of an IC engine can be arranged on either the inner camshaft 52 or the outer camshaft 54. Exhaust lobes 58 that actuate exhaust valves (not shown) of an IC engine can be arranged on either the inner camshaft 52 or the outer camshaft 54, or whichever one does not have intake lobes 56. The first camshaft phaser 10A can be configured to be connected to either the inner camshaft 52 or the outer camshaft 54 of the concentric camshaft assembly 50. The second camshaft phaser 10B can be configured to be connected to either the inner camshaft 52 or the outer camshaft 54 of the concentric camshaft assembly 50 or whichever one is not connected to the first camshaft phaser 10A. Connection of the second camshaft phaser 10B to the concentric camshaft assembly 50 can be accomplished via a motion transfer assembly 40 that is connected to the second camshaft phaser 10B and configured to be connected to the either the inner camshaft 52 or the outer camshaft 54. The camshaft phaser arrangement 100 of FIG. 1 can utilize camshaft phasers of any actuation type, including, but not limited to hydraulically actuated, termed "hydraulic camshaft phaser" or electrically actuated with an electric motor, termed "electric camshaft phaser." However, camshaft phasers that utilize other actuation methods are also possible. Multiple arrangements of electric and hydraulic camshaft phasers for the concentric camshaft assembly 50 will now be described.

Figure 2A:
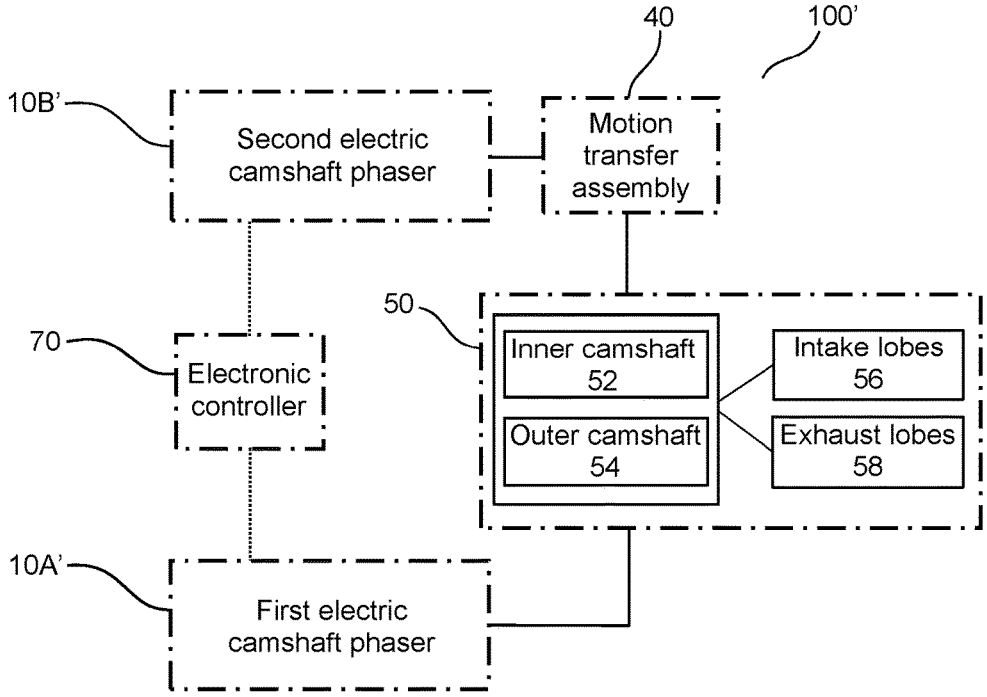
FIG. 2A is a schematic diagram of an example embodiment of a camshaft phaser arrangement, including a first electric camshaft phaser and a second electric camshaft phaser, configured for a concentric camshaft assembly.
Figure 2B:
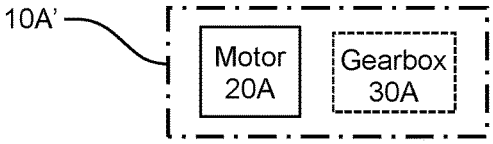
FIG. 2B is a schematic diagram of an example embodiment of the first electric camshaft phaser of FIG. 2A.

Referring to FIG. 2A, a schematic diagram is shown of an example embodiment of a camshaft phaser arrangement 100' configured for the previously described concentric camshaft assembly 50. This camshaft phaser arrangement 100' includes a first electric camshaft phaser 10A' and a second electric camshaft phaser 10B'. Various forms for the first and second electric phasers 10A', 10B' are possible. FIG. 2B shows one such form, represented schematically for the first electric phaser 10A', that includes a first motor 20A and an optional first gearbox 30A.

Electric camshafts offer functional advantages over hydraulic camshafts, including, but not limited to faster actuation rates and an ability to actuate a corresponding camshaft to a desired angular position during conditions in which hydraulic camshaft phasers are typically not functional. Hydraulic camshaft phasers rely on pressurized hydraulic fluid, such as engine oil, for actuation. During engine startup, engine-off, or engine shutdown conditions, oil pressure can be inadequate for actuation of a hydraulic camshaft phaser; however, electric camshaft phasers can be configured to receive an electronic signal from an electronic controller to actuate a corresponding camshaft to a desired angular position relative to a crankshaft of an IC engine during these and other conditions, as long as an electrical power source is provided.

Figure 3A:
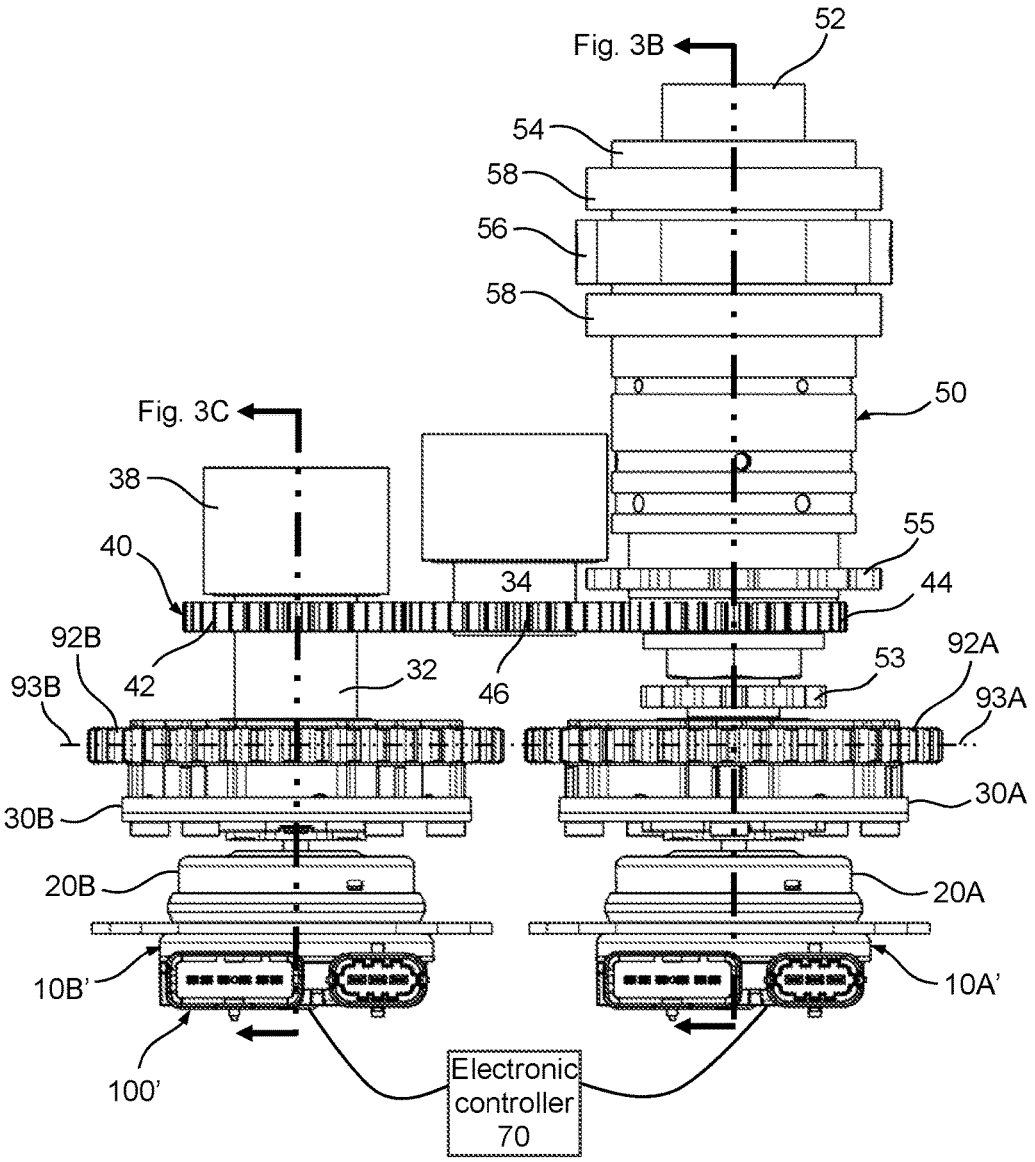
FIG. 3A is a top view of the camshaft phaser arrangement schematically shown in FIG. 2A.
Figure 3B:
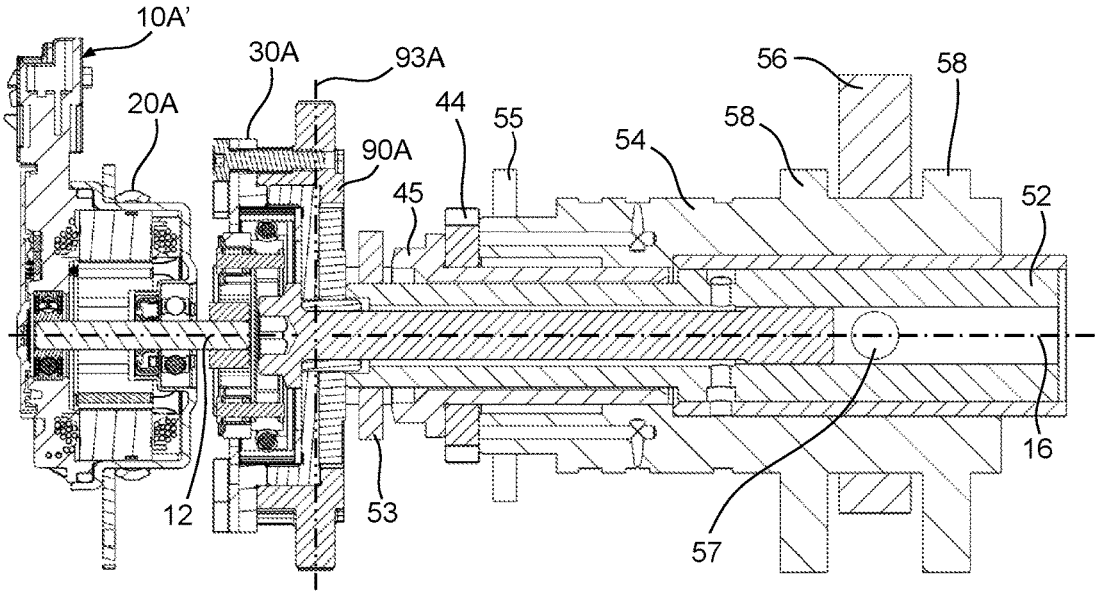
FIG. 3B is a cross-sectional view taken from FIG. 3A.
Figure 3C:
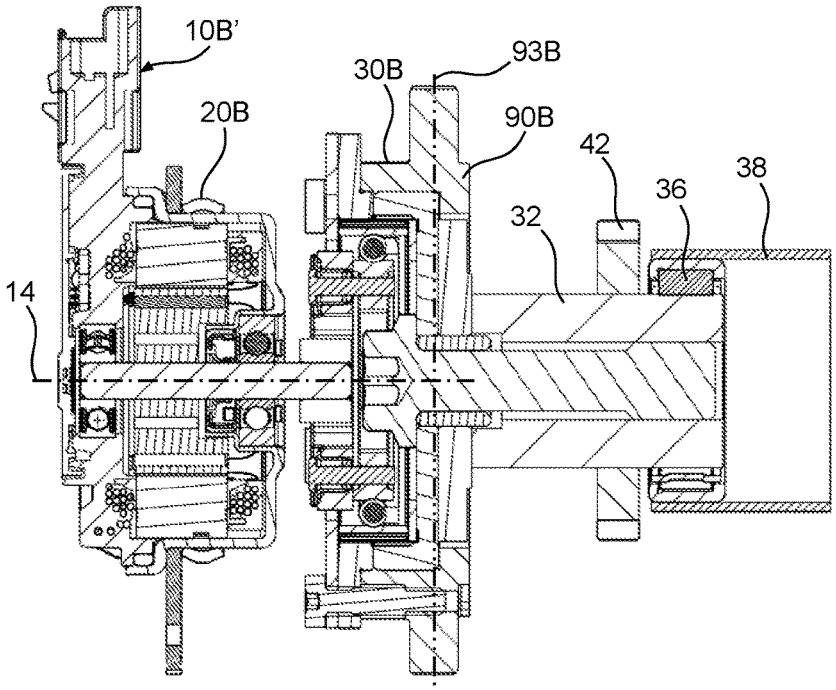
FIG. 3C is a cross-sectional view taken from FIG. 3A.
Figure 4:
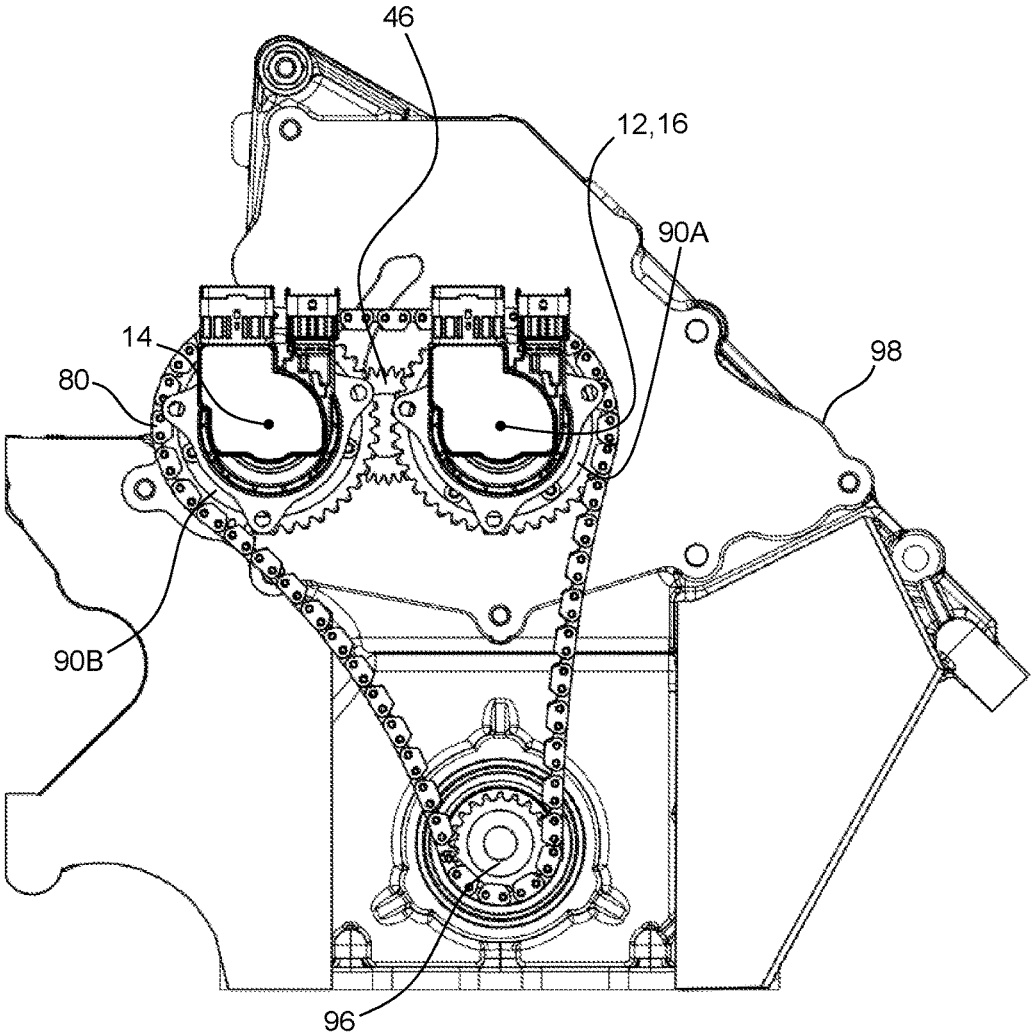
FIG. 4 is a front view of the camshaft phaser arrangement shown in FIG. 3A installed on an IC engine.

FIG. 3A is a top view of an example embodiment of the camshaft phaser arrangement 100' shown in the schematic view of FIG. 2A. FIGS. 3B and 3C are cross-sectional views taken from FIG. 3A. FIG. 4 provides a front view of the camshaft phaser arrangement 100' shown in FIG. 3A installed on an IC engine 98. The following discussion should be read in light of FIGS. 3A through 4. The camshaft phaser arrangement 100' includes a first driven wheel 90A and a second driven wheel 90B. Both the first and second driven wheels 90A, 90B are configured to be driven by a driving wheel 96. The driving wheel 96 can be connected to a crankshaft of the IC engine 98, or any component or power source that is capable of driving the first and second driven wheels 90A, 90B. The driving wheel 96 and first and second driven wheels 90A, 90B can be part of a drive system that is connected by an endless drive band 80. More than one endless drive band can be arranged to drive the first and second driven wheels 90A, 90B. The endless drive band 80 (or endless drive bands) can be a chain or belt that interfaces with a first endless drive band interface 92A on the first driven wheel 90A and a second endless drive band interface 92B on the second driven wheel 90B. A first center plane 93A of the first endless drive band interface 92A can be coplanar with a second center plane 93B of the second endless drive band interface 92B to facilitate, but not necessitate, the use of a single endless drive band 80. The first electric camshaft phaser 10A' is connected to the first driven wheel 90A; the first electric camshaft phaser 10A' is also configured to be connected to either the inner camshaft 52 or the outer camshaft 54 of the concentric camshaft assembly 50. The second electric camshaft phaser 10B' is connected to the second driven wheel 90B; the second electric camshaft phaser 10B' is also configured to be connected to either the inner camshaft 52 or the outer camshaft 54, or whichever one is not connected to the first electric camshaft phaser 10A'. In an example embodiment, the first electric camshaft phaser 10A' is configured to be connected to the inner camshaft 52, and the second electric camshaft phaser 10B' is configured to be connected to the outer camshaft 54; it is also possible for the first electric camshaft phaser 10A' to be configured to be connected to the outer camshaft 54, and the second electric camshaft phaser 10B' to be configured to be connected to the inner camshaft 52. In the camshaft phaser arrangement 100' of FIGS. 3A through 4, the second electric camshaft phaser 10B' includes a second electric motor 20B and an optional second gearbox 30B, however, other electric phaser configurations are also possible.

Referring specifically to FIGS. 3A and 3B, an intake lobe 56, a mere representation of several possible intake lobes, is connected to the inner camshaft 52 by an attachment pin 57; and, two exhaust lobes 58, a mere representation of several possible exhaust lobes, are attached to the outer camshaft 54 by an interference fit. Other suitable methods and design configurations for attaching the intake lobe 56 and exhaust lobes 58 could also be utilized. Additionally, it is possible and may be necessary to switch the locations of the lobes such that the intake lobe 56 is connected to the outer camshaft 54 and the exhaust lobes 58 are attached to the inner camshaft 52. To facilitate angular position monitoring of the inner camshaft 52 and the outer camshaft 54, an inner camshaft trigger wheel 53 is connected to the inner camshaft 52 and an outer camshaft trigger wheel 55 is connected to the outer camshaft 54. However, other locations and forms of camshaft trigger wheels are also possible.

The camshaft phaser arrangement 100' is advantageous for packaging on an IC engine. Typically, a camshaft phaser and its corresponding camshaft are arranged such that a central axis of the camshaft phaser is aligned with a central axis of the camshaft that it is phasing; this arrangement can also be described as the camshaft phaser being coaxially connected to its corresponding camshaft. Instead of a coaxial stacking arrangement of both the first and second electric camshaft phasers 10A', 10B' on an end of the concentric camshaft assembly 50, the first electric camshaft phaser 10A' is configured to be coaxially connected with either the inner camshaft 52 or the outer camshaft 54, and the second electric camshaft phaser 10B' is configured to be non-coaxially connected to either the inner or outer camshaft 52, 54, or whichever camshaft is not connected to the first electric camshaft phaser 10A'. Referring specifically to FIGS. 3B, 3C and 4, a first central axis 12 of the first electric camshaft phaser 10A' is coaxial with a third central axis 16 of the concentric camshaft assembly 50. As the first electric camshaft phaser 10A' is configured to be connected to either the inner camshaft 52 or outer camshaft 54, it could be stated that the first electric camshaft phaser 10A' is configured to be coaxially connected to either the inner camshaft 52 or outer camshaft 54; and, the second electric camshaft phaser 10B' is configured to be non-coaxially connected to either the inner camshaft 52 or outer camshaft, or whichever one is not connected to the first electric camshaft phaser 10A'. Alternatively stated, a second central axis 14 of the second electric camshaft phaser 10B' is not aligned with the third central axis 16 of the concentric camshaft assembly 50. With this non-coaxial camshaft phaser arrangement 100', valuable axial space is conserved which improves IC engine packaging within a vehicle environment.

The second electric camshaft phaser 10B' can be connected to the concentric camshaft assembly 50 by a motion transfer assembly 40. In an example embodiment, the motion transfer assembly 40 includes a first phase control drive wheel 42, a second phase control driven wheel 44, and a third intermediate phase control wheel 46. The first phase control drive wheel 42 can be connected to both the second electric camshaft phaser 10B' and the concentric camshaft assembly 50. Attachment of the first phase control drive wheel 42 to the second electric camshaft phaser 10B' can be accomplished via a phase shaft 32, however, many other attachment configurations are possible. The first phase control drive wheel 42 can be connected to the phase shaft 32 by an interference fit or any other suitable connection method. Several arrangements that include a bearing 36 and a mounting shaft 38 can be utilized to facilitate securing of the second electric camshaft phaser 10B' to an IC engine or any other receiving structure. Attachment of the second phase control driven wheel 44 to the concentric camshaft assembly 50 can be accomplished via a clamping cylinder 45 that provides an axial clamping force to clamp or hold the second phase control driven wheel 44 against the outer camshaft 54 of the concentric camshaft assembly 50. Many other attachment methods and arrangements of the first phase control drive wheel 42 and the second phase control driven wheel 44 are also possible. The third intermediate phase control wheel 46 is arranged between the first phase control drive wheel 42 and the second phase control driven wheel 44. An idler shaft 34 can be arranged to attach the third intermediate phase control wheel 46 to an IC engine or any other receiving structure. The first phase control drive wheel 42, the second phase control driven wheel 44, and the third intermediate phase control wheel 46 can be formed as gears, sprockets, pulleys or any other power transmission device that connects the second electric camshaft phaser 10B' to either the inner camshaft 52 or the outer camshaft 54 of the concentric camshaft assembly 50. The motion transfer assembly 40 can be arranged in many different configurations, including, but not limited to those that eliminate the third intermediate phase control wheel 46 and/or utilize drive chains or belts within the motion transfer assembly 40.

Figure 5:
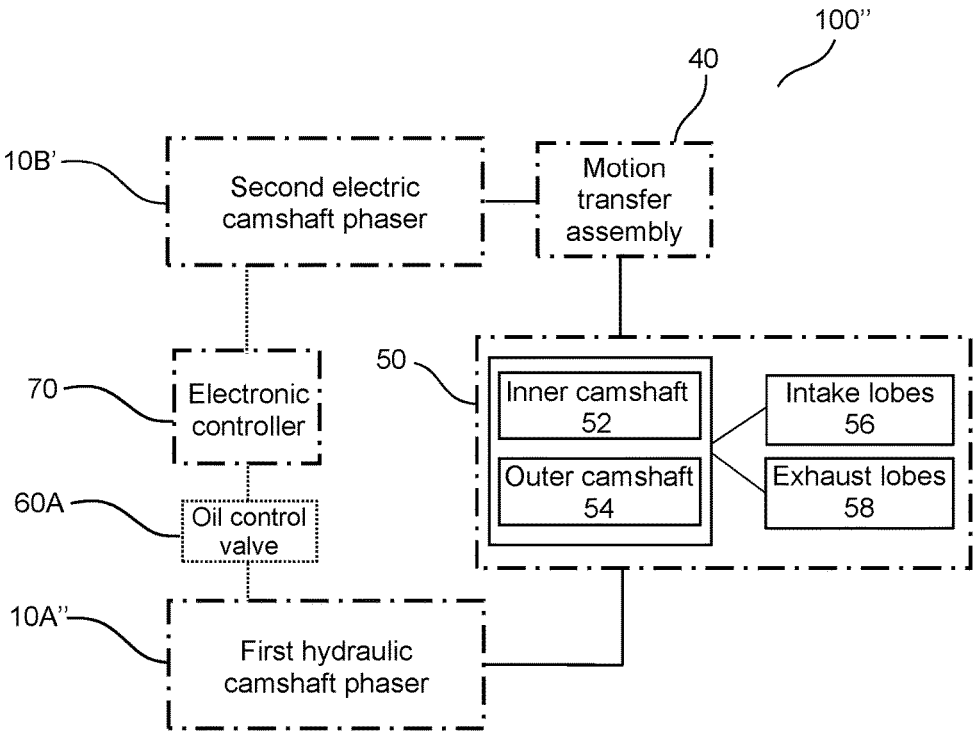
FIG. 5 is a schematic diagram of an example embodiment of a camshaft phaser arrangement, including a first hydraulic camshaft phaser and a second electric camshaft phaser, configured for a concentric camshaft assembly.

Referring to FIG. 5, an example embodiment of a camshaft phaser arrangement 100" is schematically shown with a first hydraulic camshaft phaser 10A", together with the second electric camshaft phaser 10B'. A first oil control valve 60A together with the electronic controller 70 manage an angular position of the first hydraulic camshaft phaser 10A". The first oil control valve 60A can be integrated within the first hydraulic camshaft phaser 10A" or arranged remotely from the first hydraulic camshaft phaser 10A". The electronic controller 70 can send an electronic signal to actuate the first hydraulic camshaft phaser 10A" to a desired angular position. In the camshaft phaser arrangement 100" of FIG. 5, the first hydraulic camshaft phaser 10A" can be arranged coaxially with the concentric camshaft assembly 50, and the second electric camshaft phaser 10B' can be arranged non-coaxially with the concentric camshaft assembly 50; however, the positions of these two camshaft phasers 10A", 10B' can be switched so that the first hydraulic camshaft phaser 10A" can be arranged non-coaxially with the concentric camshaft assembly 50 and the second electric camshaft phaser 10B' can be arranged coaxially with the concentric camshaft assembly 50.

Figure 6:
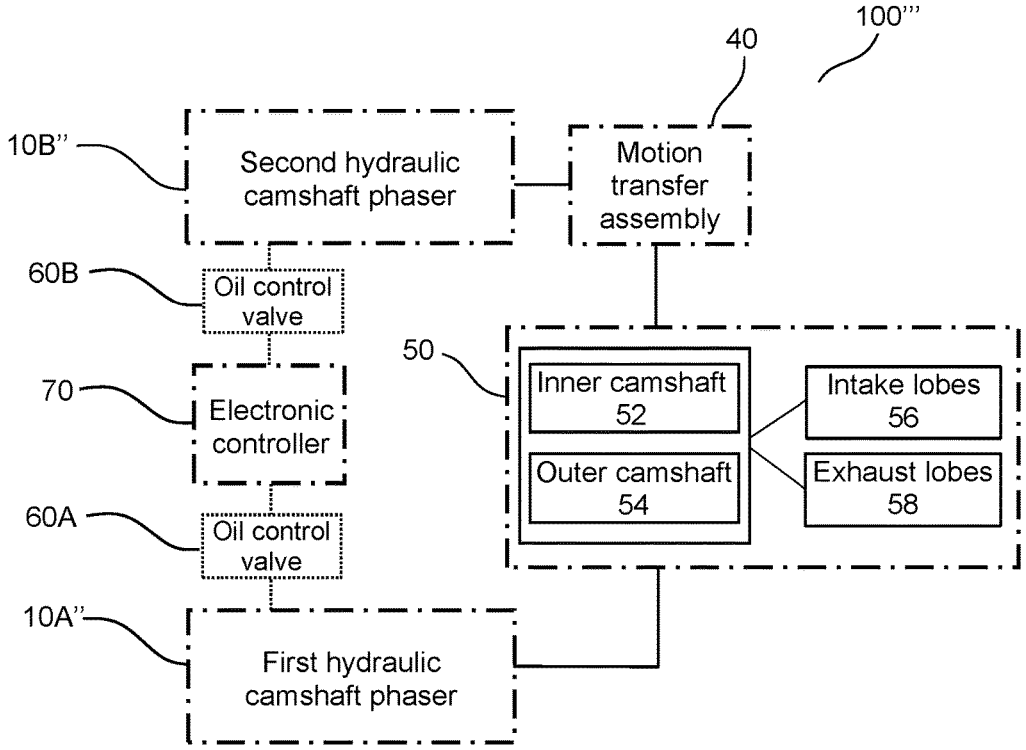
FIG. 6 is a schematic diagram of an example embodiment of a camshaft phaser arrangement, including a first hydraulic camshaft phaser and a second hydraulic camshaft phaser, configured for a concentric camshaft assembly.

Referring to FIG. 6, an example embodiment of a camshaft phaser arrangement 100'" is schematically shown with the first hydraulic camshaft phaser 10A" paired with a second hydraulic camshaft phaser 10B". A second oil control valve 60B together with the electronic controller 70 manage an angular position of the second hydraulic camshaft phaser 10B".

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser arrangement configured for a concentric camshaft assembly having inner and outer camshafts, the camshaft phaser arrangement comprising:

a first driven wheel configured to be driven by a driving wheel;

a second driven wheel configured to be driven by the driving wheel;

a first camshaft phaser connected to the first driven wheel, the first camshaft phaser configured to be coaxially connected to one of the inner or outer camshafts; and, a second camshaft phaser connected to the second driven wheel, the second camshaft phaser configured to be non-coaxially connected to a remaining one of the inner or outer camshafts.

2. The camshaft phaser arrangement of claim 1, wherein the first camshaft phaser is configured to be connected to the inner camshaft and the second camshaft phaser is configured to be connected to the outer camshaft.

3. The camshaft phaser arrangement of claim 1, wherein the first driven wheel includes a first endless drive band interface and the second driven wheel includes a second endless drive band interface.

4. The camshaft phaser arrangement of claim 3, wherein a first center plane of the first endless drive band interface and a second center plane of the second drive band interface are coplanar.

5. The camshaft phaser arrangement of claim 4, wherein the first and second endless drive band interfaces are configured to engage an endless drive band that connects the first and second driven wheels to the driving wheel.

6. The camshaft phaser arrangement of claim 1, further comprising a motion transfer assembly connected to the second camshaft phaser and configured to be connected to the remaining one of the inner or outer camshaft.

7. The camshaft phaser arrangement of claim 6, wherein the motion transfer assembly includes:

a first phase control drive wheel;

a second phase control driven wheel; and, a third intermediate phase control wheel between the first phase control drive wheel and the second phase control driven wheel.

8. The camshaft phaser arrangement of claim 7, wherein the first phase control drive wheel is actuated by the second camshaft phaser and the second phase control driven wheel is configured to be connected to one of the inner or outer camshaft.

9. The camshaft phaser arrangement of claim 1, wherein at least one of the first or second camshaft phasers is a hydraulic camshaft phaser.

10. The camshaft phaser arrangement of claim 1, wherein at least one of the first or second camshaft phasers is an electric camshaft phaser.

11. The camshaft phaser arrangement of claim 10, wherein the at least one of the first or second camshaft phasers further comprises:

an electric motor; and, a gearbox connected to the electric motor, the gearbox and electric motor configured to provide phase control to either the inner or outer camshaft.

12. The camshaft phaser arrangement of claim 10, wherein the at least one of the first and second camshaft phasers is configured to receive an electronic signal to actuate either the inner or outer camshaft to a desired angular position.

13. The camshaft phaser arrangement of claim 10, wherein the at least one of the first or second camshaft phasers is configured to actuate at least one of the inner or outer camshafts during an engine-off condition.

14. The camshaft phaser arrangement of claim 10, wherein the at least one of the first or second camshaft phasers is configured to actuate at least one of the inner or outer camshafts during an engine startup condition.

15. A camshaft phaser arrangement configured for a concentric camshaft assembly having inner and outer camshafts, the camshaft phaser arrangement comprising:

a first driven wheel connected to a first camshaft phaser, the first driven wheel configured to be driven by a driving wheel of a crankshaft; and, a second driven wheel connected to a second camshaft phaser, the second driven wheel configured to be driven by the driving wheel of the crankshaft; and, the first camshaft phaser is configured to be coaxially connected to the inner camshaft; and, the second camshaft phaser is configured to be non-coaxially connected to the outer camshaft by a motion transfer assembly.

16. A camshaft phaser arrangement configured for a concentric camshaft assembly having inner and outer camshafts, the camshaft phaser arrangement comprising:

a first camshaft phaser configured to be coaxially connected with one of the inner or outer camshafts; and, a second camshaft phaser configured to be non-coaxially connected to a remaining one of the inner or outer camshafts.

17. The camshaft phaser arrangement of claim 16, wherein at least one of the first or second camshaft phasers is an electric camshaft phaser.

18. The camshaft phaser arrangement of claim 16, wherein at least one of the first or second camshaft phasers is a hydraulic camshaft phaser.

19. The camshaft phaser arrangement of claim 16, further comprising a first endless drive band interface connected to the first camshaft phaser and a second endless drive band interface connected to the second camshaft phaser.

20. The camshaft phaser arrangement of claim 19, wherein a first center plane of the first endless drive band interface and a second center plane of the second endless drive band interface are coplanar.

* * * * *